US005222660A

United States Patent [19]

Koss

[11] Patent Number: 5,222,660

[45] Date of Patent: Jun. 29, 1993

[54] FLIP-TOP CARTON FOR POWDERED DETERGENT

[75] Inventor: Richard J. Koss, Iselin, N.J.

[73] Assignee: Accurate Box Company, Inc., Paterson, N.J.

[21] Appl. No.: 806,715

[22] Filed: Dec. 12, 1991

[51] Int. Cl.[5] ..... B65D 5/54; B65D 5/56

[52] U.S. Cl. ..... 229/231; 220/441; 220/443; 493/96; 493/114; 493/907

[58] Field of Search ..... 220/416, 418, 441, 443; 229/101, 225, 231, 235; 493/95, 96, 97, 114, 907

[56] References Cited

U.S. PATENT DOCUMENTS

| | | | |
|---|---|---|---|
| 900,953 | 10/1908 | Reber . | |
| 901,286 | 10/1908 | Ferres et al. | 229/225 |
| 2,339,656 | 1/1944 | Shina | 229/231 |
| 2,348,377 | 5/1944 | Goodyear . | |
| 2,470,388 | 5/1949 | Ball . | |
| 2,881,967 | 4/1959 | Ringler . | |
| 3,048,324 | 8/1962 | Anderson . | |
| 3,207,416 | 6/1964 | Koltz et al. . | |
| 3,291,372 | 12/1966 | Saidel | 229/101 |
| 3,302,847 | 2/1967 | Hennessey . | |
| 3,347,446 | 10/1967 | Guyer et al. . | |
| 3,426,956 | 2/1969 | Frohlicher . | |
| 4,126,263 | 11/1978 | Martensson . | |
| 4,421,236 | 12/1983 | Lowe . | |
| 4,913,292 | 4/1990 | Field | 229/125 |
| 4,986,420 | 1/1991 | Gunn et al. | 229/117.22 |
| 5,058,748 | 10/1991 | Giblin et al. | 220/416 |

FOREIGN PATENT DOCUMENTS

| | | | |
|---|---|---|---|
| 613063 | 1/1961 | Canada | 229/235 |
| 697686 | 11/1964 | Canada . | |
| 864947 | 3/1971 | Canada . | |
| 1017728 | 9/1977 | Canada . | |
| 443930 | 8/1991 | European Pat. Off. | 229/235 |
| 2046484 | 9/1970 | Fed. Rep. of Germany . | |
| 3140390 | 10/1981 | Fed. Rep. of Germany . | |
| 2485486 | 6/1980 | France . | |
| 2639917 | 12/1988 | France . | |
| 608106 | 9/1960 | Italy | 229/235 |
| 320019 | 1/1970 | Sweden | 220/418 |

*Primary Examiner*—Gary E. Elkins

*Attorney, Agent, or Firm*—Lerner, David, Littenberg, Krumholz & Mentlik

[57] ABSTRACT

A carton, a box-blank for making a carton and a method of making a box-blank, each of a material having two layers, or a laminated corrugated cardboard, there being provided a substantially separable section and a tear strip for separating the outer layer from the inner such that the inner layer forms a collar to at least partially define an opening in the carton or the carton made from the box-blank.

39 Claims, 2 Drawing Sheets

FLIP-TOP CARTON FOR POWDERED DETERGENT

BACKGROUND OF THE INVENTION

The present invention relates generally to cartons and methods for making the same, and more particularly, but not exclusively, to cartons for holding siftable materials such as powder detergents and a method for making a blank of which such carton is made.

In recent years, the rising costs of consumer goods and increasing consumer awareness of environmental issues has spawned an increase in the development of products and packaging which are not only less expensive to package, transport and shelve, but are also more environmentally sound. It is unquestionable that most consumers would prefer their products to be packaged more efficiently so that the cost of the product to the consumer is minimized, raw materials are not wasted and the resultant refuse is limited. However, it is human nature to want the best of all worlds. Thus, there is a need to provide quality goods which are packaged in such a way that a balance is struck between consumer appeal, durability, cost (in initial packaging, transportation and shelving), and waste (which should be minimized at production and disposal). Many manufacturers of consumer goods have responded by providing concentrated powders, liquids, etc., while many manufacturers of packages and packaging houses have responded by providing less expensive and more innovative packages which are sometimes smaller.

Even so, there are several shortcomings with regard to such packages. For instance, one problem with currently-available cardboard containers for powdered detergents is that such packages cannot be filled to capacity because of the placement of a pouring spout on the side of the carton. Because the powder would immediately spill out of the spout upon its initial opening if the container was filled to capacity, the container is actually made larger than necessary and then not filled to capacity to prevent such undesirable spillage. Containers of this type are undesirable because additional material must be used in manufacturing such cartons. The cost of utilizing such additional material and transporting and shelving the larger carton is passed on to the consumer. Moreover, the use of such additional materials in production necessarily increases the amount of refuse.

Other containers for siftable materials attempt to solve this "empty top" problem by providing a top flap which opens to allow the consumer to scoop out the powder. Although such a design solves the problem of not filling the container to capacity, it is difficult to initially retrieve a scoop buried in the powder without spilling some of the powder. In addition, it is often awkward and time-consuming to measure out the proper amount of the powdered material without spillage. Still further, a separate scoop is usually provided, adding to packaging waste and increasing costs. Lastly, providing covers for such opening, if it is done at all, also increases the costs of the product and the waste resulting therefrom.

Although anxious to meet consumer demand, manufacturers still desire to keep their manufacturing costs to a minimum while providing a quality product. Concerns of the manufacturer include the need to reduce the number of different materials or the amount of material used in the fabrication of the container as well as the need to reduce the steps and time required to manufacture and assemble the container. Accordingly, it is desirable for the manufacturer to eliminate separately attached pouring spouts, separate covers and extra scoops, not only from the standpoint of reducing the use of additional materials, such as plastic or metal, but also from an assembly standpoint. In most cases, the less manufacturing steps required, the less the cost to the manufacturer and ultimately to the consumer.

Thus, attempts have been made to provide containers which solve the aforementioned problems. Most of these attempts, however, have proven unsatisfactory, either to the consumer, the manufacturer, or both.

For example, U.S. Pat. No. 4,913,292 to Field discloses a flip-top dispensing carton with an improved pouring spout having wing elements to control the flow of powdered material therefrom. Although the spout does, to some extent, control the partially-filled container problem by providing an inner collar which extends to the top of the carton, the manufacturing of such a carton involves further, costly steps. Namely, the additional steps of first forming the inner collar by cutting a separate smaller panel form paperboard and then gluing the panel to the main blank which forms the carton must be taken at the expense of the manufacturer.

Similarly, U.S. Pat. No. 4,421,236 to Lowe discloses a carton for powdered materials that is capable of being filled to capacity. The pouring spout, however, is formed by providing additional cardboard which must be, in turn, folded and glued to form external depending flanges for frictional engagement with the outside of the container. Again, the manufacturing costs of such a container in unsatisfactory in that it requires additional steps and materials.

Other cartons which can be formed from one contiguous blank nevertheless still suffer from manufacturing and assembly problems. For example, U.S. Pat. No. 3,048,324 to Anderson provides a carton formed from a single blank. The blank, however, uses additional paperboard which is folded to form both an outer container as well as an inner container. This construction incurs additional costs in assembly as well as in raw materials. Likewise, U.S. Pat. No. 3,426,956 to Frohlicher discloses a carton that may be formed from one piece, but again, its construction requires considerable folding and gluing to construct the flip-top by forming depending flanges to frictionally engage the outer walls of the container.

Accordingly, the present invention solves the aforementioned consumer and manufacturer shortcomings by providing an environmentally-sound and inexpensive container that is not only sturdy and capable of being filled to capacity, but can also be manufactured and assembled with fewer steps and in less time, and uses less materials than previous containers which do not even provide the same advantages.

SUMMARY OF THE INVENTION

The present invention relates to a carton having a plurality of panels which together define an interior, the panels being made of single, foldable blank having an inner and outer layer and at least one separable section where at the inner and outer layers can be separated, and separation means for separating the inner and outer layer from one another so that the separated outer layer can be moved to form an opening, at least a portion of the separated inner layer defining the opening.

The separation means of a carton can be of any suitable material, structure or arrangement, though it is preferred that a separate tear strip be utilized in conjunction with frangible lines in the outer layer.

In the preferred embodiment, the material used to make the carton is a laminated corrugated cardboard, whereby the inner layer is corrugated and the outer layer is a thin, smooth layer of cardboard which is susceptible to high quality printing and decoration.

While it is preferred that the thin, smooth layer of cardboard be adherently connected to the corrugated inner layer at all points other than at the at least one separable section, it is possible that the respective layers will be adhered to one another at strategic points of contact, whereby the layers would be substantially inseparable at all portions except at the at least one separable section. Indeed, there may even be some type of connection at the at least one separable section, though such connection should be such that the outer layer can be readily separated from the inner layer.

The present invention also relates to the box blank of which the carton can be made. Thus, the box blank would include at least two layers of material which are connected to one another at all areas except the separable section. The blank also includes the separation means for separating the outer layer from the inner layer when a carton is in assembled condition. As with the carton itself, the separation means could vary in material, structure and arrangement. Also as with the carton, the blank could include indicia of any type, which would include printing, decoration, product information, etc.

The present invention also contemplates a method, and the box blank made thereby, in which a first foldable layer of material and a second foldable layer of material are connected to one another such that there is at least one separable section provided where at the first and second layers can be readily separated from one another when the carton to be made from the box blank is in assembled form, forming a plurality of fold lines in the first and second layers to define the plurality of panels which will define an interior when the carton is in assembled form, and providing separation means to facilitate the separation of the first and second layers in the area of the separable section. The separable section can be established in accordance with the method in any suitable manner, including the application of a non-adherent coating, such as varnish, to which a suitable adhesive would not adhere, the suitable adhesive being applied to substantially all areas of at least one of the outer or inner layers. Alternatively, the adhesive used to connect the inner and outer layers can be applied to all areas, or portions of all areas, other than the separable section. This eliminates the step of applying a non-adherent coating, though the step of applying a non-adherent coating may be less complicated and less expensive than selectively applying adhesive to areas other than the area of the separable section.

Thus, it is an object of the present invention to provide a carton made of a material having at least two layers, the outer layer being separable from the inner layer to form an opening at which the inner layer establishes a collar which at least partially defines the opening to the carton.

It is another object of the present invention to provide a box blank from which the carton in the foregoing paragraph can be made.

It is another object of the present invention to provide a method of making a box blank, and the box blank is made from such method, whereby few steps are required to provide a quality carton of the type described above.

BRIEF DESCRIPTION OF THE DRAWINGS

The foregoing and other objects of the present invention will become apparent, as will a better understanding of the concepts underlying the present invention, by reference to the description which follows and refers to the accompanying drawings in which.

DETAILED DESCRIPTION OF THE INVENTION

Figure 1:
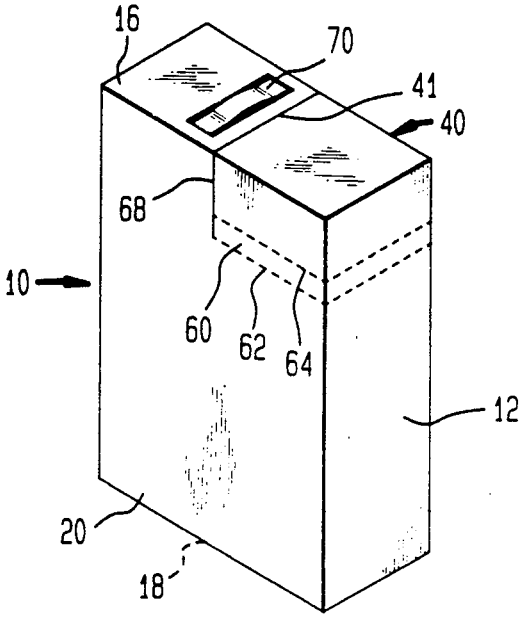
FIG. 1 is a perspective view of the assembled carton in accordance with the present invention.

Referring to the figures, FIG. 1 illustrates a carton generally designated as 10, in accordance with the present invention. In the preferred embodiment, carton 10 has six sides made up of front panel 12, back panel 14, top panel 16, bottom panel 18, and side panels 20 and 22. Fewer or additional panels, however, may be employed to vary the strength, shape, and aesthetics of the particular container desired.

Figure 5:
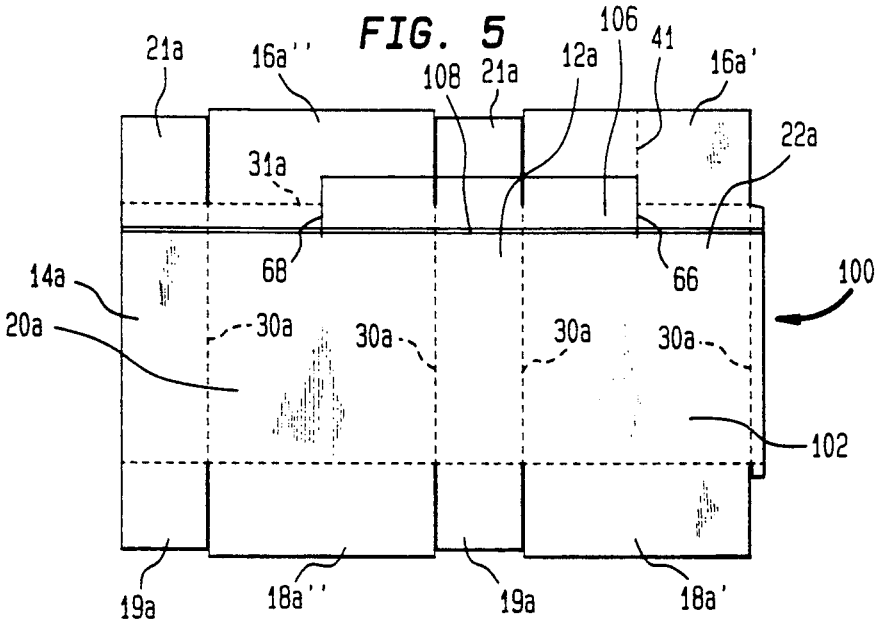
FIG. 5 is a plan view of the outer layer of the box blank in accordance with the present invention.
Figure 6:
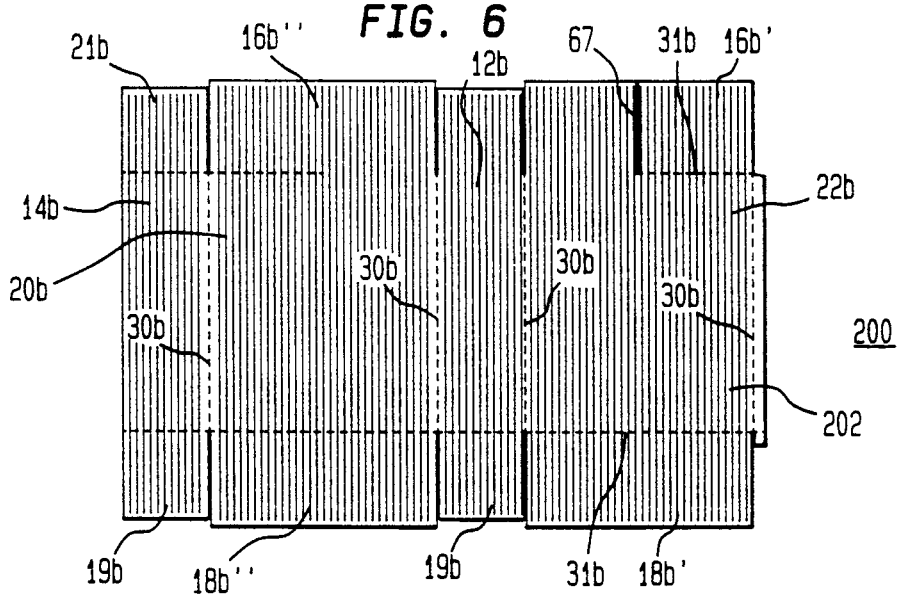
FIG. 6 is a plan view of the inner layer of the box blank in accordance with the present invention.
Figure 7:
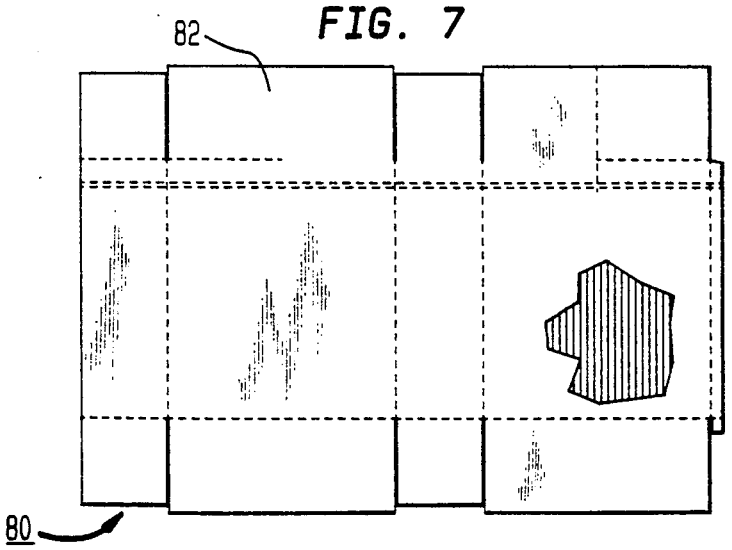
FIG. 7 is a partially cut-away plan view of the box blank revealing both the inner and outer layers.

Referring to FIG. 7, a single, multi-layered box blank generally designated as 80 is adapted to form carton 10. Box blank 80 is preferably formed from a laminated cardboard material (FIG. 7) having an outer layer 100 (FIG. 5) and an inner layer 200 (FIG. 6), though more than two layers may be employed so that the box will have certain desirable characteristics. Inner layer 200 is preferably formed from corrugated cardboard or other similar corrugated material which is sufficiently rigid and durable for providing the requisite support for the carton 10, while outer layer 100 is preferably a smooth, printable paper laminate. Outer layer 100 and inner layer 200 will hereinafter be referred to as outer laminate layer 100 and inner corrugated layer 200 respectively, appreciating that materials other than a laminate and corrugated paperboard may be employed to form blank 80 without departing from the scope and spirit of the present invention.

In the preferred embodiment, inner corrugated layer 200 and outer laminate layer 100 are similarly sized and shaped such that inner corrugated layer 200 and outer laminate layer 100 can be secured to one another, as described below, to form a single box blank 80, which is foldable to form carton 10.

Because the preferred materials for box blank 80 are corrugated cardboard and a paper laminate, longitudinal fold lines 30*a* and lateral fold lines 31*a* on outer laminate layer 100 (FIG. 5) and corresponding longitudinal fold lines 30*b* and lateral fold lines 31*b* on inner corrugated layer 200 (FIG. 6) are formed in a conventional manner. Preferably, fold lines 30*a*, 31*a*, 30*b*, and 31*b* are formed simultaneously in box blank 80, after outer laminate layer 100 has been secured to inner corrugated layer 200. Accordingly, fold lines 30*a* and 31*a* on outer laminate layer 100 define panels which form the outer layers panels 12, 14, 16, 18, 20, and 22 of carton 10. Thus, formed in outer laminate layer 100 is front panel 12*a*, back panel 14*a*, side panels 20*a* and 22*a*, intermediate panels 19*a* and 21*a*, as well as top panels 16*a'* and 16*a''* which in assembled condition overlap one another to form the outer layer of top panel 16 of carton 10, and bottom panels 18*a'* and 18*a''* which are overlapped to form the outer layer of bottom panel 18 of carton 10. Similarly, fold lines 30*b* and 31*b* on inner corrugated layer 200 define corresponding front panel 12*b*, back panel 14*b*, side panels 20*b* and 22*b*, intermediate panels 19*b* and 21*b*, as well as top panels 16*b'* and 16*b''* which overlap to form the inner layer of top panel 16 of carton 10, and bottom panels 18*b'* and 18*b''* which overlap to form the inner layer of bottom panel 18 of carton 10.

Carton 10 further includes a built-in flip top which has been generally designated as 40 (FIGS. 1–4) in accordance with the preferred embodiment of the present invention. To form flip-top 40, box blank 80 is provided with a separable section 82 (FIG. 7) at which inner corrugated layer 200 and outer laminate layer 100 can be readily separated from one another. Accordingly, separable section 82 will allow a portion of outer laminate layer 100 to separate from inner corrugated layer 200 to thereby form flip top 40 (FIG. 3) when carton 10 is in its final assembled form as described below.

Separable section 82 is formed in box blank 80 before box blank 80 is folded and glued to form carton 10. Separable section 82 is formed by first providing the inside surface 102 of outer laminate layer 100 with a generally non-adherent area 106 (FIG. 5), preferably by coating non-adherent area 106 with a layer of varnish or similar coating that will prevent the bonding of the two layers in that area. Non-adherent area 106 preferably extends from a top medial region of side panel 22*a*, across the top region of front panel 12*a*, to a top medial region of side panel 20*a*. Alternatively, a non-adherent area may be provided on the outside surface 202 of inner corrugated layer 200 corresponding with non-adherent area 106 on outer laminate layer 200, or on both outside surface 202 of inner corrugated layer 200 and inside surface 101 of outer laminate layer 100 in areas corresponding to non-adherent area 106.

In the preferred method, non-adherent area 106 is selectively coated with a layer of glue-repelling varnish, and then the entire inside surface 102 of outer laminate layer 100 is coated with any suitable adhesive. Inside surface 102 of outer laminate layer 100 is then adhered to outside surface 202 of inner corrugated layer 200. Accordingly, outer laminate layer 100 will be secured to inner corrugated layer 200 at all points of attachment except at non-adherent area 106. It is also possible to secure outer laminate layer 100 to inner corrugated layer 200 in only a few selected areas rather that at all points of attachment, of course excluding non-adherent area 106 where there should be no adhesive or at the very least an easily separable connection. Outer laminate layer 100 may even be partially secured to inner corrugated layer 200 around the non-adhesive area 106, so long as flip-top 40 is capable of being readily separated from carton 40. In other embodiments of the present invention, non-adherent area 106 need not be coated with a glue-repelling layer; rather, adhesive may be selectively applied to the inner corrugated layer 200 so that no adhesive is applied in non-adherent area 106. Thus, separable section 82 will still be formed in accordance with the present invention.

In the preferred embodiment of the flip-top 40, a dual tear strip arrangement is employed. Accordingly, outer laminate layer 100 of box blank 80 is scored about the area corresponding to the flip-top 40 to provide a pair of parallel perforation lines 62 and 64 to form a cardboard tear strip 60 therebetween consisting of section of outer laminate layer 100 (FIG. 1). Perforation lines 62 and 64 preferably extend from a top-medial region of side panel 20 across front panel 12 to a correspondingly-opposed top medial region of side panel 22 of outer laminate layer 100. A separate tear strip 108, preferably made of a relatively strong plastic material, is further provided between outer laminate layer 100 and inner corrugated layer 200 about the area corresponding to cardboard tear strip 60 so as to facilitate separation of the outer layer from the inner layer. Preferably, separate tear strip 10B is initially provided on inside surface 102 across the entire width of outer laminate layer 100 (FIG. 5) and is then cut at medial cut lines 66 and 68 at the outer boundaries of non-adhesive area 106. Cut lines 66 and 68 are also provided to eliminate the need for both tear strips 60 and 108 to extend down from top panel 16 to side panels 20 and 22.

Figure 2:
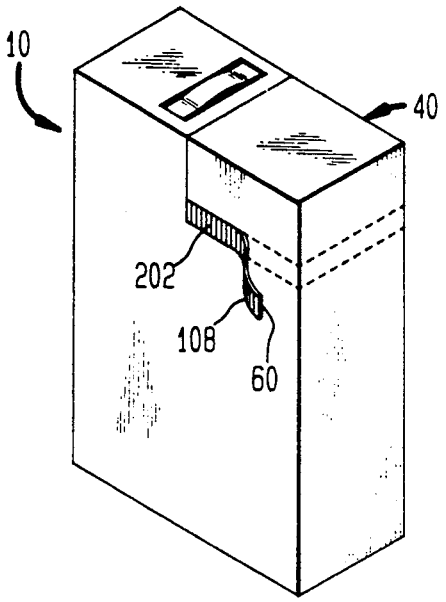
FIG. 2 is a perspective view of the carton in FIG. 1, as illustrating the carton as it is being opened by a tear strip.
Figure 3:
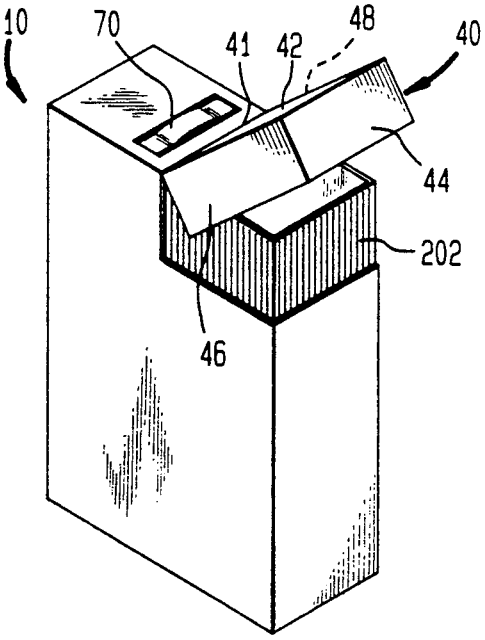
FIG. 3 is a perspective view of the carton in FIG. 1, illustrating the cover in an open position after the tear strip has been removed.
Figure 4:
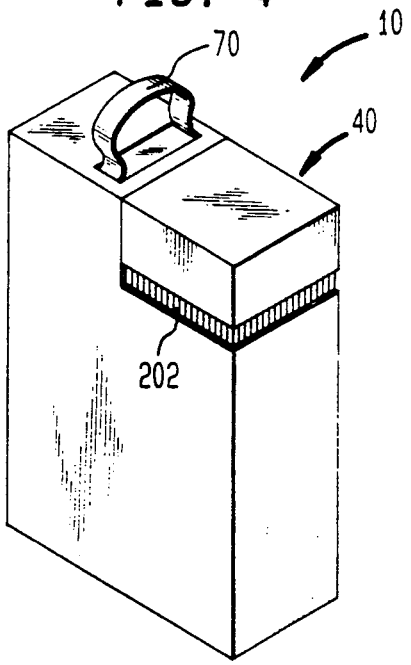
FIG. 4 is a perspective view of the carton in FIG. 1, illustrating the cover in a closed position.

To release flip-top 40, cardboard tear strip 60 and separate tear strip 108 are simultaneously grasped and pulled away from side panel 20, front panel 12, and side panel 22 of carton 10 (FIG. 2). Once released, flip-top 40 includes front depending flange 44 and side depending flanges 46 and 48, each flange being formed from a portion of outer laminate layer 100, and top flap 42, which is formed from a section of top panel 16 which has portions of both outer laminate layer 100 and inner corrugated layer 200. Cut lines 66 and 68 and hinge line 41 allow flip-top 40 to be hinged across top panel 16 of carton 10 at hinge line 41 as shown in FIG. 3. Cut line 67 (FIG. 6) is also preferably provided in inner corrugated layer 200 to permit the hinging of flip-top 40 to be hinged only to outer laminate layer 100 at hinge line 41. Flip-top 40 is thus reclosable as depending flanges 44, 46, and 48 will frictionally engage corresponding sections of inner corrugated layer 200 (FIG. 4).

Although in the preferred embodiment two tear strips are employed, it is also possible to employ cardboard tear strip 108 alone, or separate tear strip 108 alone with a single perforated line, for example only perforation line 62 in outer laminate layer 100. Furthermore, it is also possible not to provide any tear strips at all, for example, by providing lines of perforation readily frangible by the application of upward force on flip-top 40 to release it from carton 10. Of course, any suitable means may be utilized to provide the separation.

In other embodiments of the present invention, flip-top 40 may extend across the entire top panel 16 (not shown) and be hinged at the fold line where back panel 14 meets top panel 16. Furthermore, flip-top 40 need not be hinged to carton 10 and thus could be removably replaceable on carton 10. Many types of covers can be provided without departing from the spirit and scope of the present invention.

Finally, a handle 70 may be provided to assist with the carrying of carton 10. One such known collapsible handle scheme is shown in FIGS. 1–4.

While the foregoing description and figures illustrate the preferred embodiment of the carton and method in accordance with the present invention, it should be appreciated that certain modifications can be made and are encouraged to be made in the structure of the disclosed embodiment without departing from the spirit and scope of the present invention which is intended to be captured by the claims set forth immediately below.

I claim:

1. A carton comprising:

a. a plurality of panels defining an interior, said panels being formed by a single foldable blank having at least an inner and outer layer and having at least one separable section at which said inner and outer layers can be readily separated, wherein said inner layer is substantially the same size and shape as said outer layer, being substantially coextensive therewith, and b. separation means for separating said outer layer from said inner layer in at least a portion of said separable section of said blank such that said separated outer layer can be moved to form an opening in said carton, said separation means and said outer and inner layers being so constructed and arranged with respect to one another that upon movement of said separated outer layer, at least a portion of said separated inner layer defines said opening.

2. The carton of claim 1, wherein said inner layer is formed from corrugated cardboard and said outer layer is formed from sheet material having a substantially smooth and printable outer surface.

3. The carton of claim 1, wherein said panels include front, back, side, top, and bottom panels connected along adjacent fold lines.

4. The carton of claim 1, wherein said separation means comprises at least one frangible line in said outer layer arranged at said separable section.

5. The carton of claim 1, wherein said separation means comprises two parallel frangible lines in said outer layer arranged at said separable section, whereby the portion of said outer layer between said two parallel lines serves as a tear strip.

6. The carton of claim 1, wherein said separation means comprises a separate tear strip arranged at said separable section.

7. The carton of claim 6, wherein said separate tear strip is disposed between said inner and outer layers.

8. The carton of claim 5, wherein said separation means further includes a separate tear strip disposed between said inner and outer layers at said separable section.

9. The carton of claim 3, wherein said carton further comprises a hinged flip-top.

10. The carton of claim 9, wherein the hinge of said hinged flip-top is medially disposed on said top panel.

11. A box blank for forming a carton comprising:

a. a plurality of panels foldable to form an interior when said carton is in assembled form, said blank having at least an inner and outer layer and having a separable section at which said inner and outer layers can be readily separated from one another when said carton is in assembled form, wherein said inner layer is substantially the same size and shape as said outer layer and is registered therewith, and b. separation means for separating at least a portion of said separable section of said blank when said carton is in assembled form such that said separated outer layer can be moved to form an opening in said carton, said separation means and said outer and inner layers being so constructed and arranged with respect to one another that upon movement of said separated outer layer, at least a portion of said inner layer defines said opening.

12. The blank of claim 11, wherein said inner layer is formed from corrugated cardboard and said outer layer is formed from a sheet material having a substantially smooth and printable outer surface.

13. The blank of claim 11, wherein said panels include front, back, side, top, and bottom panels connected along adjacent fold lines, and at least a portion of said panels include indicia of some type.

14. The blank of claim 11, wherein said separation means comprises at least one frangible line in said outer layer arranged at said separable section.

15. The blank of claim 11, wherein said separation means comprises two parallel frangible lines in said outer layer arranged at said separable section whereby the portion of said outer layer between said two parallel lines serves as a tear strip.

16. The blank of claim 11, wherein said separation means comprises a separate tear strip arranged at said separable section.

17. The blank of claim 16, wherein said separate tear strip is disposed between said inner and outer layers.

18. The blank of claim 15, wherein said separation means further includes a separate tear strip disposed between said inner and outer layers at said separable section.

19. The blank of claim 13, wherein said carton further comprises a hinged flip-top.

20. The blank of claim 19, wherein the hinge of said hinged flip-top is medially disposed on said top panel.

21. A method of making a box blank which is adapted to form a carton, said method comprising the steps of:

a. providing a first layer of foldable material and a second layer of foldable material, wherein said first and second layers are substantially the same size and shape as one another;

b. registering said first layer with said second layer, and connecting said first layer to said second layer such that at least one separable section is provided at which said first and second layers can be readily separated from one another when the carton is in assembled form;

c. forming a plurality of fold lines in said first and second layers to thereby define a plurality of panels; and d. providing separation means to facilitate the separation of at least a portion of said second layer from said first layer when the carton is in assembled form such that said separable section can be moved to form an opening in said carton, said opening to be defined by at least a portion of said first layer.

22. The method of claim 21, wherein said plurality of fold lines in said inner and outer layers are formed substantially simultaneously.

23. The method of claim 21, including the steps of applying a non-adherent coating to at least one of said first and second layers in said separable section and applying an adhesive to substantially all areas of at least one of said first and second layers.

24. The method in claim 21, including the step of applying adhesive to all areas of at least one of said first and second layers except said separable section.

25. The method of claim 21, including the step of forming at least one frangible line in said second layer arranged at said separable section.

26. The method of claim 21, including the step of forming two parallel frangible lines in said second layer at said separable section, whereby the portion of said second layer between said two parallel lines can serve as a tear strip or part thereof.

27. The method of claim 21, including the step of providing a separate tear strip arranged at said separable section.

28. The method of claim 21, including the step of providing a separate tear strip between said first and second layers.

29. The method of claim 25, including the step of providing a separate tear strip between said first and second layers.

30. A box blank which is adapted to form a carton, said box blank being made in accordance with a method, said method comprising the steps of:

a. providing a first layer of foldable material and a second layer of foldable material, wherein said first and second layers are substantially the same size and shape as one another;

b. registering said first layer with said second layer, and connecting said first layer to said second layer such that at least one separable section is provided at which said first and second layer can be readily separated from one another when the carton is in assembled form;

c. forming a plurality of fold lines in said first and second layers to thereby define a plurality of panels; and d. providing separation means to facilitate the separation of at least a portion of said second layer from said first layer when the carton is in assembled form such that said separable section can be moved to form an opening in said carton, said opening to be defined by at least a portion of said first layer.

31. The box blank in claim 30, wherein the method includes the step of applying a non-adherent coating to at least one of said first and second layers in said separable section and applying an adhesive to substantially all areas of at least one of said first and second layers.

32. The box blank in claim 30, wherein the method includes the step of applying adhesive to all areas of at least one of said first and second layers except said separable section.

33. A method of making a box blank which is adapted to form a carton, said method comprising the steps of:

a. providing a first layer of foldable material and a second layer of foldable material;

b. connecting said first layer to said second layer such that at least one separable section is provided at which said first and second layers can be readily separated from one another when the carton is in assembled form, such connection being established by applying a non-adherent coating to at least one of said first and second layers in said separable section and applying an adhesive to substantially all areas of at least one of said first and second layers;

c. forming a plurality of fold lines in said first and second layers to thereby define a plurality of panel; and d. providing separation means to facilitate the separation of at least a portion of said second layer from said first layer when the carton is in assembled form such that said separable section can be moved to form an opening in said carton, said opening to be defined by at least a portion of said first layer.

34. A method of making a box blank which is adapted to form a carton, said method comprising the steps of:

a. providing a first layer of foldable material and a second layer of foldable material;

b. connecting said first layer to said second layer such that at least one separable section is provided at which said first and second layers can be readily separated from one another when the carton is in assembled form, such connection being established by applying adhesive to all areas of at least one of said first and second layers except said separable section;

c. forming a plurality of fold lines in said first and second layers to thereby define a plurality of panel; and d. providing separation means to facilitate the separation of at least a portion of said second layer from said first layer when the carton is in assembled form such that said separable section can be moved to form an opening in said carton, said opening to be defined by at least a portion of said first layer.

35. A carton comprising:

a. a plurality of panels defining an interior, said panels being formed by a single foldable blank having at least an inner and outer layer and having at least one separable section at which said inner and outer layers can be readily separated, wherein said inner layer is a single sheet of corrugated cardboard and said outer layer is a single sheet of thin sheet material having a smooth outer surface susceptible to high quality printing and decoration, and b. separation means for separating said outer layer from said inner layer in at least a portion of said separable section of said blank such that said separated outer layer can be moved to form an opening in said carton, said separation means and said outer and inner layers being so constructed and arranged with respect to one another that upon movement of said separated outer layer, at least a portion of said separated inner layer defines said opening.

36. The carton in claim 35, wherein said sheet material is clay coated.

37. A box blank for forming a carton comprising:

a. a plurality of panels foldable to form an interior when said carton is in assembled form, said blank having at least an inner and outer layer and having a separable section at which said inner and outer layers can be readily separated from one another when said carton is in assembled form, wherein said inner layer is a single sheet of corrugated cardboard and said outer layer is a single sheet of thin sheet material having a smooth outer surface susceptible to high quality printing and decoration, and b. separation means for separating at least a portion of said separable section of said blank when said carton is in assembled form such that said separated outer layer can be moved to form an opening in said carton, said separation means and said outer and inner layers being so constructed and arranged with respect to one another that upon movement of said separated outer layer, at least a portion of said inner layer defines said opening.

38. A method of making a box blank which is adapted to form a carton, said method comprising the steps of:

a. providing a single sheet of corrugated cardboard and a single sheet of a thin sheet material having a substantially smooth outer surface susceptible to high quality printing and decoration;

b. connecting said single sheet of corrugated cardboard to said single sheet of a thin sheet material such that at least one separable section is provided at which said corrugated cardboard and thin sheet material can be readily separated from one another when the carton is in assembled form;

c. forming a plurality of fold lines in said first and second layers to thereby define a plurality of panels; and d. providing separation means to facilitate the separation of at least a portion of said thin sheet material from said corrugated cardboard when the carton is in assembled form such that said separable section can be moved to form an opening in said carton, said opening to be defined by at least a portion of said corrugated cardboard.

39. A box blank which is adapted to form a carton, said box blank being made in accordance with a method comprising the steps of:

a. providing a single sheet of corrugated cardboard and a single sheet of a thin sheet material having a substantially smooth outer surface susceptible to high quality printing and decoration;

b. connecting said single sheet of corrugated cardboard to said single sheet of a thin sheet material such that at lest one separable section is provided at which said corrugated cardboard and thin sheet material can be readily separated from one another when the carton is in assembled form;

c. forming a plurality of fold lines in said first and second layers to thereby define a plurality of panels; and d. providing separation means to facilitate the separation of at least a portion of said thin sheet material from said corrugated cardboard when the carton is in assembled form such that said separable section can be moved to form an opening in said carton, said opening to be defined by at least a portion of said corrugated cardboard.

* * * * *

UNITED STATES PATENT AND TRADEMARK OFFICE

CERTIFICATE OF CORRECTION

PATENT NO. : 5,222,660

DATED : June 29, 1993

INVENTOR(S) : Richard J. Koss

It is certified that error appears in the above-identified patent and that said Letters Patent is hereby corrected as shown below:

Column 6, line 26, "10B" should read --108--

Column 12, line 10, "lest" should read --least--

Signed and Sealed this

Fifteenth Day of March, 1994

Bruce Lehman

*Attest:*

BRUCE LEHMAN

*Attesting Officer*

*Commissioner of Patents and Trademarks*